US005623249A

United States Patent [19]

Camire

[11] Patent Number: 5,623,249

[45] Date of Patent: Apr. 22, 1997

[54] VIDEO MONITOR MOTION SENSOR

[75] Inventor: Arthur J. Camire, Calumet City, Ill.

[73] Assignee: New Product Development, Inc., Orland Park, Ill.

[21] Appl. No.: 379,686

[22] Filed: Jan. 26, 1995

[51] Int. Cl.[6] ..... G08B 13/18

[52] U.S. Cl. ..... 340/555; 340/511; 340/693; 348/155

[58] Field of Search ..... 340/555, 541, 340/511, 693; 348/154, 155; 250/221; 364/516, 517

[56] References Cited

U.S. PATENT DOCUMENTS

| | | | |
|---|---|---|---|
| 3,536,831 | 10/1970 | Kanemaki et al. | 348/155 |
| 3,812,287 | 5/1974 | Lemelson | 348/155 |
| 3,816,648 | 6/1974 | Noll et al. | 348/154 |
| 4,455,550 | 6/1984 | Iguchi | 340/511 X |

*Primary Examiner*—Thomas Mullen

*Attorney, Agent, or Firm*—Varnum, Riddering, Schmidt & Howlett LLP

[57] ABSTRACT

Motion is detected from a surveillance monitor by means of a photosensor attached to the monitor screen and an electric circuit connected to the sensor which generates an alarm signal in response to changes in the level of an electric output signal generated by the sensor. The sensor is housed within a suction cup which is readily attached to any part of the screen and is readily movable to any desired area of the screen to be monitored for motion. The electric circuit includes comparators which detect changes in light intensity greater than a predetermined magnitude defined by a window about a preselected voltage level. The circuit includes an operational amplifier and a transistor connected to the output of the sensor and the circuit provides an effective impedance equal to the impedance of the sensing device at various levels of intensity such that the reference voltage level, for detection purposes, is the same at all levels of steady state light intensity. The magnitude of the window is defined by a voltage divider having one end connected to the output of the operational amplifier and the window is adjusted with changes in average light intensity levels.

10 Claims, 2 Drawing Sheets

VIDEO MONITOR MOTION SENSOR

BACKGROUND OF THE INVENTION

1. Field of the Invention

The invention relates to motion detection devices used in conjunction with video surveillance devices and to more particular to devices for detecting motion from an image on a video surveillance monitor.

2. Background Art

Video surveillance devices are commonly used for many applications in which the primary reason for the surveillance is to detect unauthorized activity such as the unauthorized opening of a doorway or other unauthorized activity. Basically, a monitoring camera is required for each area to be monitored and is typically connected by means of a cable to a dedicated monitor. In large installations, a single watch person is often responsible for observing a number of monitors in a single location. Alarm devices are known which alert the watch person to activity in an area under surveillance. The known devices are inserted in the transmission cable between a camera and a monitor and, by means of a processing of the electronic signals transmitted from the camera to the monitor, detect changes in the signals which are representative of changes in light intensity. Changes in light intensity are interpreted as movement in the area covered by the camera. Control circuitry allows the observer to designate an area of the field of view of the camera as the area to be analyzed by the alarm device. The alarm device generates an alarm, e.g. an audible alarm, when the analyzed signals indicate that a change in light intensity has occurred in the area under observation.

A disadvantage of prior art alarm devices, relying upon interpretation of electrical signals transmitted by the camera, is that the device must be inserted in the cable extending between the camera and the monitor. The installation must be done by skilled technicians and is therefore typically a permanent installation. A further disadvantage of the prior art units is the expensive circuitry required for analysis of the complex video signal transmitted between the camera and the monitor. The prior art unit typically requires monitoring system nobs on a control panel accessible to the watch person to allow the watch person to select various areas of the picture to be monitored.

The requirements for motion detection in various areas vary from time to time and may well vary between different time periods in the same day. It is therefore desirable to have a motion detector, that can be selectively activated for each monitored location. However, the expense of permanently installing a unit such as known in the prior art for each camera installation is expensive. Furthermore, the equipment often is used for only a small portion of the total time that the camera is activated.

SUMMARY OF THE INVENTION

These and other problems of the prior art are overcome in accordance with the present invention which includes a photoelectric sensor attachable to the face of a video monitor and an electric circuit connected to the sensor which generates an alarm signal in response to changes in the level of an electrical output signal generated by the sensor. Advantageously, the unit is relatively simple and inexpensive in that it operates on basis of changes in electrical signal level and does not require sophisticated analysis of a complex video signal, as is done in the prior art. Furthermore, the unit is readily portable. The sensing unit is a commonly used photoelectric device mounted in a suction cup or the like which readily attaches to, and is readily removed from, the face of a video monitor screen. It may be positioned on any desired area of the video monitor screen. The sensing device is connected by electrical wires to an alerting unit containing detection circuitry and alarm devices. The unit is readily portable and requires minimum space. Advantageously, more than one monitoring device may be attached to a single screen allowing for the simultaneous monitoring of two or more separate portions of a screen, which is generally not possible by means of prior art devices.

In accordance with one aspect of the invention, the device adapts to the current level of light intensity detected by the sensor and detects motion in the environment by determining changes from the existing level. In one embodiment of the invention, the circuitry includes an integrator having an input connected to the sensor and active circuit device, such as a transistor, connected between the output of the integrator and the sensor. The effective impedance presented by the integrator and the active circuit device is adjusted to equal the impedance of the sensing device, which changes with changes in light intensity on the sensing device. Advantageously, in this manner the circuit node from which changes are measured to detect a change in light intensity representative of motions is maintained at an approximate midpoint of the voltage level supplied to the sensing device.

As a consequence, the change in voltage that results from a given percentage change in light is independent of the brightness of the field and a uniformity of measurement is obtained in the presence of light and dark fields.

In one embodiment of the invention, the signaling detection circuit comprises a pair of comparators connected to the sensor, with one comparator having a reference input which is a predetermined amount greater than the steady state signal and the other comparator having a reference input which is less than the average steady state signal by the same predetermined amount. In accordance with one aspect of the invention, the predetermined value above and below the steady state signal varies with the change in level of the steady state signal such that the window defined by the reference inputs is wider in the case of a bright field and narrower in the case of a dark field. Advantageously, the circuit of this invention compensates for the difference in relative magnitude of change which results from introducing an object in a dark field as opposed to a light field.

BRIEF DESCRIPTION OF THE DRAWING

An embodiment of the invention is described below with reference to the drawing in which.

DETAILED DESCRIPTION

Figure 1:
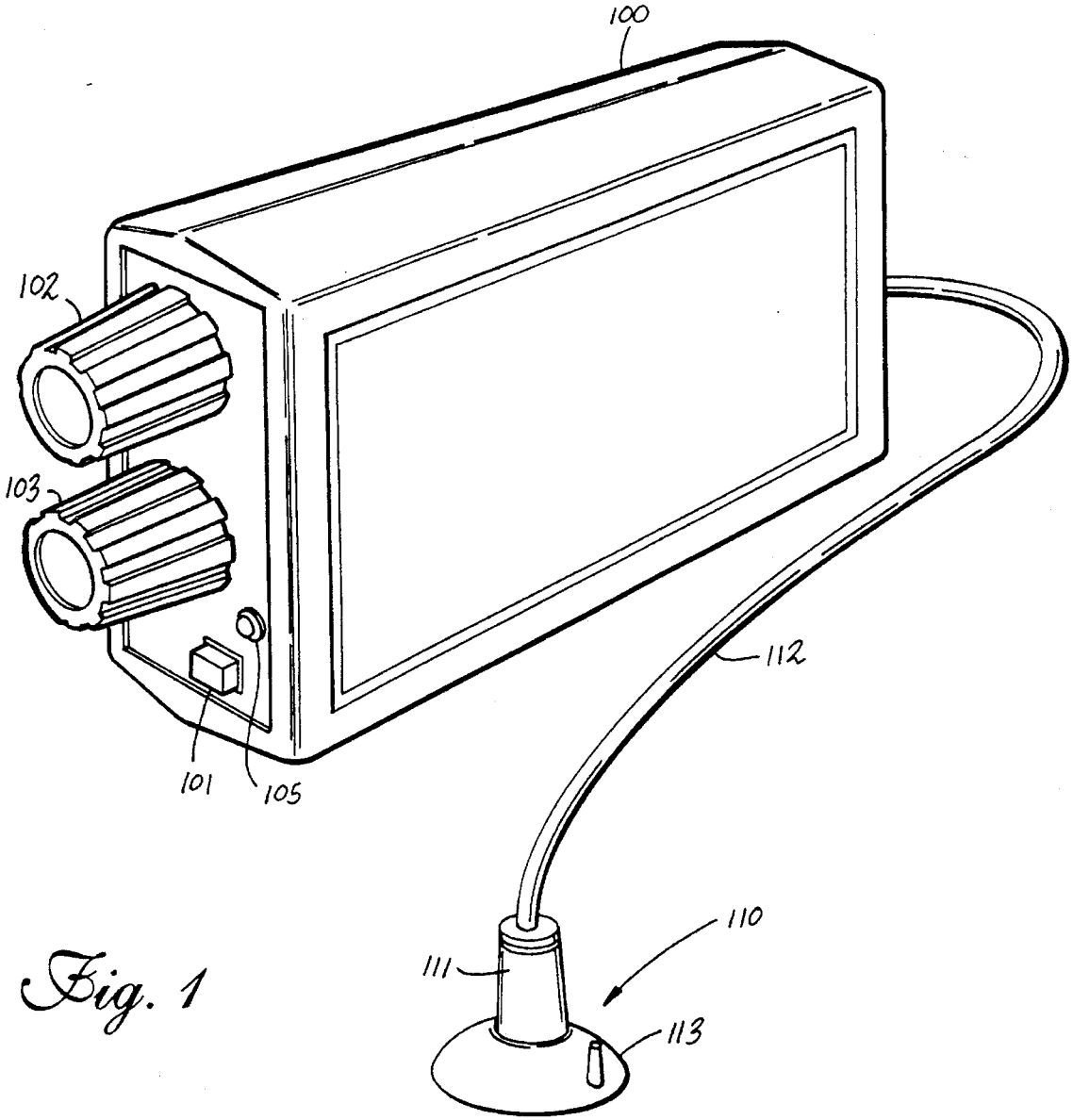
FIG. 1 is a perspective representation of motion sensing apparatus for use with a surveillance device in accordance with the principles of the invention.
Figure 1A:
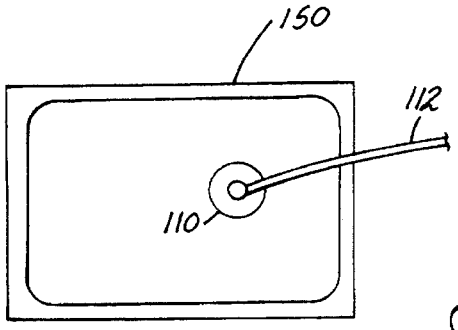
FIG. 1*a* is a frontal view of a video surveillance monitor.

FIG. 1 shows a sensor signalling unit 100 provided with an on-off switch 101, a volume control knob 102 and a sensitivity adjustment knob 103 as well as a visible light source 105. A sensor unit 110 is connected to the unit 100 via electrical wiring in cable 112. The sensor unit 110 comprises a suction cup 113 and may be applied at a selected position on the face of a video surveillance monitor 150 or any similar device having a light emitting surface. A portion 111 of the sensing unit 110 includes a photosensitive device such as a photoresistor which is electrically connected to the unit 100 via electrical wiring in cable 112. Electronic circuitry within the unit 100 senses changes in current in the photosensitive device in sensing unit 110 which are due to changes in light intensity detected from the surveillance monitor. The signalling unit 100 generates an audible signal when change in light intensity received by the sensor unit 110 exceeds a predefined threshold. Such a change in light intensity is indicative of motion in the usage on the surveillance monitor. The light source 105 is activated simultaneously with the audible alarm and remains active for a period of time after the audible alarm has been terminated. The light source gives a person responsible for several monitors an indication as to which of the several monitors has caused an audible alarm. The dimensions of the unit 100 are similar to those of a standard telephone pager unit and may be readily carried between locations. No electrical connection is required between the unit 100 and the video monitor with which it is employed other than the electrical connection from the suction cup attachment device which attaches to the face of the monitor. The suction cup 113 may be a standard, commercially available suction cup adapted to accept a light sensing device and cable 112.

Figure 2:
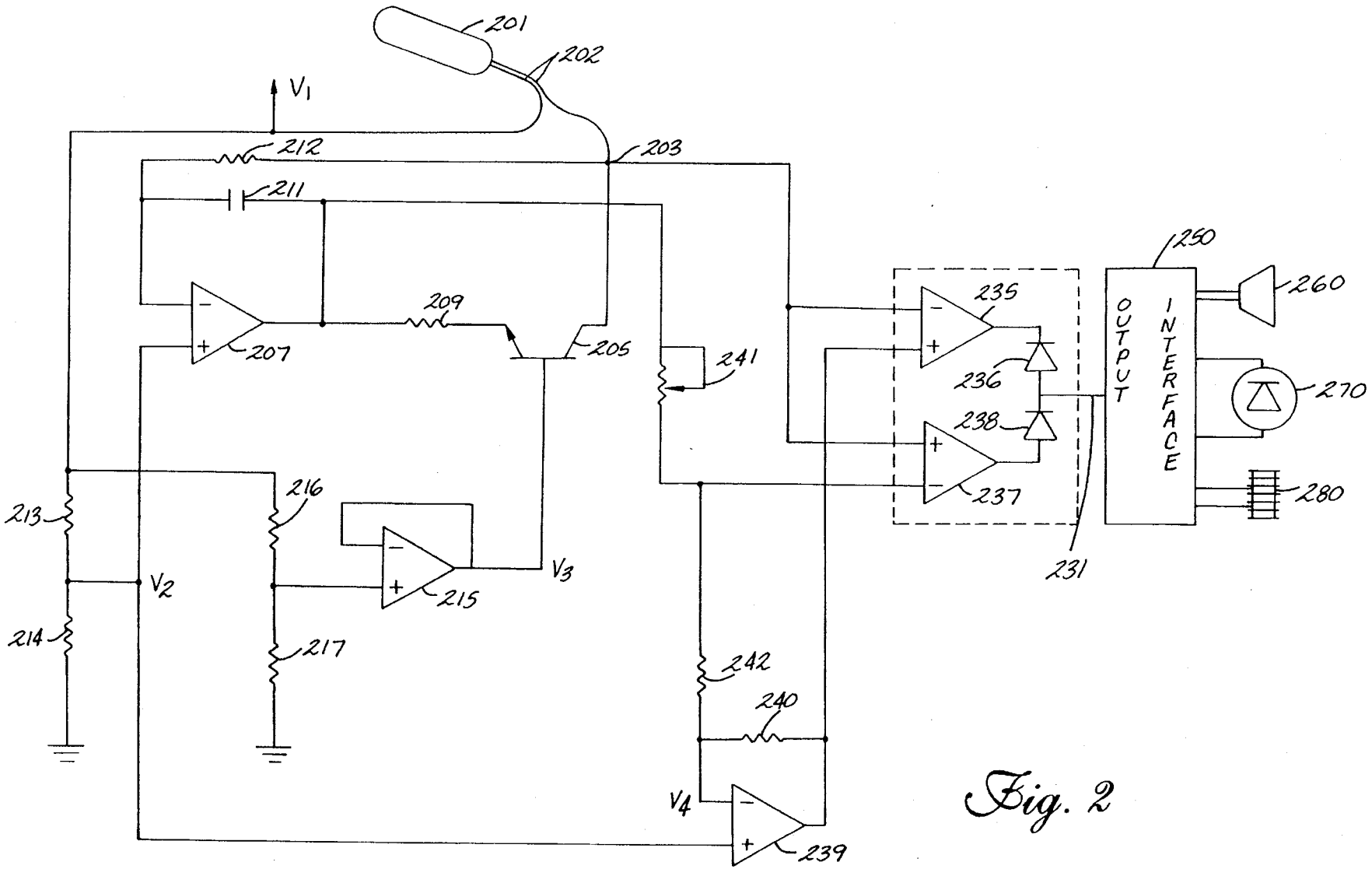
FIG. 2 is a block diagram representation of circuitry incorporated in the apparatus of FIG. 1.

FIG. 2 is a circuit diagram representation of the electronic circuitry internal to the unit 100. FIG. 2 shows a representation of a photosensing device 201. The photosensing device 201 may be a photoresistor in which the impedance decreases with increasing exposure of light or a well-known photodiode or phototransistor, all of which are commercially available devices. The photosensing device 201 is connected to the circuit by means of the electrical wiring 202, as shown in FIG. 1. The photosensing device 201 is connected between a voltage source V1 of approximately 10 volts and a node 203 of the circuit of FIG. 2. The node 203 is connected to the collector of transistor 205. It is also connected through a resistor 212 to the inverted input of operational amplifier 207. The emitter of transistor 205 is connected through a resistor 209 to the output of operational amplifier 207, which is also connected through a capacitor 211 to the inverted input. The non-inverted input of operational amplifier 207 is connected to a constant voltage source V2. The base of the transistor 205 is maintained at a constant potential. The operational amplifier 207, together with capacitor 211 and resistor 212, functions as art integrating circuit and serves to provide a bias for transistor 205. The transistor 205 provides the equivalent of a variable impedance which increases and decreases in value as the voltage at node 203 changes. Since the photosensing device 201 is connected between the voltage source V1 and the node 203, the voltage level at node 203 will change as the impedance of the photosensing device 201 changes with changes in intensity of the light incident on photosensing device 201. In the present circuit, the voltage level V1 is approximately 10 volts and voltage level V2 is approximately 5 volts. The base of transistor 205 is maintained at constant voltage V3, derived from V1 by means of a voltage divider consisting of resistors 216, 217 and operational amplifier 215.

As the intensity of light incident on the device 201 increases, its impedance decreases causing the voltage level at node 203 to rise to a higher level. This change in level at node 203 will be detected by a comparator circuit comprising a pair of comparators 235, 237, as will be described later herein. As a result of the increase in voltage level at node 203, the output of operational amplifier 207 will begin to change to a lower level. Consequently, the base to emitter voltage drop of transistor 205 will increase causing more current to flow, effectively presenting a lower impedance between node 203 and ground and causing the voltage at node 203 to return to a level approximately equal to voltage V2. Similarly, when the intensity level of light on photosensing device 201 decreases, its impedance will increase causing the voltage at node 203 to drop to a lower value. As a result, the output of operational amplifier 207 will begin to rise and current flow through transistor 205 will be reduced. Thus, the effective impedance between node 203 and ground will be increased until the voltage at node 203 reaches the level V2. The rate at which the voltage level at node 203 changes is adjustable by selection of the values of resistor 212 and capacitor 211. The time for recovery of the voltage level at node 203 is determined by the time constant of the RC circuit consisting of capacitor 211 and resistor 212. The time period for recovery of the voltage level at node 203 is preferably on the order of a few seconds to allow adequate time for detection of relatively slow changes in the field being monitored. In order to have greater sensitivity to slow changes, a longer time constant may be used together with a circuit for shunting the resistor in order to obtain fast recovery, activated by the alarm output of the circuit.

When the level of illumination on the monitor screen is high, a relative large percentage change in illumination, while resulting in a corresponding percentage change in impedance, causes a relative small magnitude impedance change in the photosensing device 201, since the total impedance of the device is smallest at high illumination levels. By means of operational amplifier 207 and transistor 205 the present circuit provides an effective impedance which is equal to that of the sensing device at all levels of illumination.

Node 203 is connected to comparators 235 and 237 which comparators function to generate an output signal indicative of a change in level at node 203 exceeding a predetermined window. The window is defined by the output of operational amplifier 239 and resistances connected thereto, as will be explained later herein. Motion is detected by the present circuit in response to change in intensity of light incident on the device 201 causing a change in the voltage level of the node 203. In the event the change exceeds the window defined by the reference inputs to comparators 235, 237, an alarm signal will be produced. Assuming that the light intensity remains at the changed level for a period of time sufficiently long to allow the operational amplifier 207 and transistors 205 to adjust to new operating levels, as explained earlier herein, the node 203 will be returned to its prior potential level which is at the approximate center of the signal detection window. A further change in light intensity, representing further movement, will again be detected if the new change exceeds the limits of the window. Thus, the current intensity detected by the photosensing device 201 becomes the reference point for detecting changes from the current state by causing the circuit to be adapted to the current state.

The node 203 connected to the photosensing device 201 is connected to the inverted input of comparator 235 and the noninverted input of comparator 237. The noninverted input of comparator 235 is connected to the output of operational amplifier 239 which has its inverted input connected to one side of a potentiometer 241, via resistor 242. The inverted input of comparator 237 is directly connected to the one side of the potentiometer 241. The other side of the potentiometer 241 is connected to the output of operational amplifier 207.

Potentiometer 241 corresponds to the sensitivity adjustment knob 103 in FIG. 1. The noninverted input of operational amplifier 239 is connected to the constant voltage source V2. The inverted input of operational amplifier 239 is also connected to its output, via resistor 240. The resistors 240 and 242 are preferably of equal value. It will be apparent from the circuit that the output of operational amplifier 239 and, hence, the noninverted input of comparator 235 is at a higher voltage than the voltage derived from the potentiometer 241 and applied to the inverted input of comparator 237. In this manner, a window is created such that a variation in the voltage level of node 203 less than a predetermined amount, either in the positive or negative direction, will not produce an alarm output signal.

The primary current path for output current of operational amplifier 239 is via resistors 240 and 242 and potentiometer 241 to the output terminal of operational amplifier 207. Thus, the amplitude of the current flowing through the resistors 240 and 242 is a function of the resistance of potentiometer 241 and the voltage level of the output operational amplifier 207. It will be apparent, that when the resistance values of resistors 240 and 242 are equal, the reference voltages applied to the comparators 235 and 237 will be above and below, respectively, a voltage V4 at the noninverted input of operational amplifier 239 by the same amount. In this manner, the window is defined about the voltage level V4 which will be maintained at the level of V2 by operation of operational amplifier 239. The sensitivity defined by the window may be adjusted by control of the potentiometer 241. As the resistance of potentiometer 241 increases, the current through the resistors 240, 242 decreases thereby narrowing the window, and vice-versa.

It is well understood that in an area of high illumination on a cathode ray tube, the change in light level with each passage of the scanning raster electron beam is much greater than in a dark area. It is therefore desirable to change the threshold of detection such that a change in the steady-state level be detectable in both light and dark areas. In the present circuit this is accomplished by changing the width of the window with changes in the average level of intensity as reflected by the output of operational amplifier 207. When the detected light intensity is of a relatively high average level, the effective impedance introduced by transistor 205 is relatively small. Under that condition, the voltage level at the output terminal of operational amplifier 207 is comparatively low and the current flowing through resistors 240 and 242 is relatively high. Accordingly, the window applied to comparators 235 and 237 is relatively wide. Similarly, when the average light intensity is relatively low, a relatively high impedance is presented by transistor 205. Under those circumstances, the output voltage of amplifier 207 is comparatively higher and the current flow through resistors 240 and 242 is comparatively lower. Consequently, the window applied to comparators 235 and 237 is narrower when the average light is relatively narrow.

The voltage level at the base of transistor 205 is maintained at a constant voltage V3 which is derived from the voltage source V1 by means of a voltage divider consisting of resistors 216, 217 and operational amplifier 215. The voltage level V3 is preset to result in a desired voltage level at the output of operational amplifier 207 when the emitter to base current of transistor 205 is at a minimum. This setting determines the minimum voltage difference between the output of operational amplifier 239 and the output of operational amplifier 207 and, hence, the minimum window for comparators 235, 237. As the field being monitored by photosensing device 201 brightens, the voltage at the output of operational amplifier 207 decreases and the current through transistor 205 increases. The value of the resistor 209, connected between the transistor 205 and the output of operational amplifier 207, determines the magnitude of change at the output of operational amplifier 207 as a result of an increase in current in transistor 205. Since the current through resistor 209 is a function of the base to emitter current in transistor 205, it functions as a bias resistor and resistor 209 could be replaced by a bias resistor connected between the output of operational amplifier 215 and the base of transistor 205.

When the level of the signal at node 203 falls within the window defined at the respective reference terminals of comparators 235 and 237, both of the comparators provide a high level output signal. When the signal at node 203 and applied to comparators 235 and 237 falls outside of the window defined at their respective reference terminals, one of these operational amplifiers will provide a low level output signal. A pair of diodes 236, 238 are connected between the outputs of comparators 235, 237, respectively, and input 231 of output interface 250 to form an AND gate. Input 231 of output interface 250 receives a low logic signal when either of the comparators 235, 237 provides a low level output signals. The output interface 250 is provided with an audible output device 260 which may, for example, be a piezo-electric buzzer which is activated by a low logic level input signal to the output interface 250 in a standard fashion. The output interface 250 is also connected to a light emitting diode 270 which is activated in a standard fashion when a low logic level signal is received by the output interface 250. A relay 280 may also be activated in response to a low logic level input signal to activate a recording device, if desired. The buzzer 260 is preferably activated for a relatively short period of time to call attention to the fact that motion has been detected. The light emitting diode 270 is preferably activated for a relatively longer period of time to provide an indication as to which of a plurality of surveillance devices was activated to produce the audible output. The light emitting diode 270 corresponds to the light source 105 shown in FIG. 1.

The circuit of the present invention adapts to gradual changes in ambient light not sufficiently abrupt to be detected by the comparators 235, 237. As changes in ambient light occur, the impedance of photosensing device 201 changes and, for reasons stated earlier, the voltage level at the output of operational amplifier 207 is adjusted accordingly. As a consequence, the center of the detection window defined at the inputs of comparators 235 and 237 is adjusted as well. Thus, the circuit adapts even in the absence of a change sufficiently large to cause an alarm signal.

It will be understood that the above described arrangement is merely illustrative of the application of the principles of the invention and that other arrangements may be devised by those skilled in the art without departing from the scope of the invention as defined by the appended claims.

I claim:

1. Motion sensing apparatus for use with a surveillance device having a light emitting surface, the apparatus comprising:

a photoelectric sensor attachable to the light emitting surface and generating an electrical output signal indicative of intensity of light emitted from a portion of the light emitting surface; and an input node electrically connected to the sensor and a first circuit element connected to the node and responsive to a change in potential at the node to restore the node to a predefined potential level and a second circuit element connected to the node and responsive to a change in potential at the node of a magnitude greater than a predetermined magnitude to generate an alarm signal.

2. The apparatus in accordance with claim 1 and wherein the first circuit element comprises an operational amplifier having a first input terminal connected to the node and a second input terminal connected to a first source of reference potential and an output terminal and wherein the first circuit element further comprises a transistor having one terminal connected to the node and another terminal connected to the output of the operational amplifier and having a base terminal connected to a second source of reference potential, the transistor responsive to a change in potential at the node to adjust current flow between the node and the output terminal of the operational amplifier to restore the node to the predefined potential level.

3. The apparatus in accordance with claim 2 and further comprising a resistor connected between the output of the operational amplifier and the emitter of the transistor.

4. The apparatus in accordance with claim 1 wherein the second circuit element comprises comparator circuitry having a first input terminal connected to a first source of reference potential of a first value and a second input terminal connected to the node and a third input terminal connected to a second source of reference potential of a second value, the comparator circuitry responsive to a potential on the second input terminal having a value falling outside a range defined by the first value and the second value to generate a comparator output signal.

5. The apparatus in accordance with claim 4 wherein the first value is higher than a predetermined value and the second value is lower than the predetermined value, the comparator circuitry comprising a first comparator having a signal input terminal connected to the node and a reference input terminal connected to the first source of reference potential, the comparator circuitry further comprising a second comparator having a signal input terminal connected to the node and a reference input terminal connected to the second source of reference potential and wherein the first comparator generates the comparator output signal when the potential on the node is greater than the first value and the second comparator generates the comparator output signal when the potential on the node is less than the second value.

6. The apparatus in accordance with claim 4 wherein the second circuit element further comprises an audible signal generating device connected to the comparator circuitry and responsive to the comparator output signal to generate an audible alarm.

7. The apparatus in accordance with claim 4 wherein the first source of reference potential comprises an operational amplifier having a first input terminal connected to a source of reference potential and having an output terminal connected the first input terminal of the comparator circuitry and wherein the operational amplifier is operative to generate a reference potential of the first value on the first input terminal of the comparator circuitry, the operational amplifier further comprising a second input terminal connected to the first input terminal of the comparator circuitry via a first resistor element and connected to the third input terminal of the comparator circuitry via a second resistor element, the apparatus further comprising a third resistor element connected between the third input terminal of the comparator circuitry and a further source of reference potential.

8. The apparatus in accordance with claim 7 wherein the first circuit element comprises an additional operational amplifier having a first input terminal connected to the node and a second input terminal connected to a source of reference potential and the first circuit element further comprises a transistor having one terminal connected to the node and another terminal connected to the output of the additional operational amplifier via a resistor and having a base terminal connected to a source of reference potential and wherein the further source of reference potential comprises the output terminal of the additional operational amplifier.

9. A method of generating an alarm signal in response to change in light output from a light emitting screen comprising the steps of:

detecting a change in light output from the screen;

defining a magnitude of change in light output from a first reference level;

generating an alarm when the magnitude of the change in light output from the first reference level exceeds a predetermined value;

defining a second reference level substantially equal to the first reference level plus the magnitude of the change in light output; and, thereafter, repeating the step of detecting; and generating an alarm signal when the magnitude of a detected change in light output from the second reference level exceeds the predetermined value.

10. A method of detecting change in light output from a light emitting screen comprising the steps of:

detecting a light output from the screen;

defining a magnitude of change in light output from a reference level;

generating an alarm when the magnitude of the change in light output from the reference level exceeds a predetermined value;

generating signals indicative of an average level of light output; and varying the reference level in accordance with changes in the signals indicative of an average level of light output.

* * * * *